US010176764B2

(12) United States Patent
Jang et al.

(10) Patent No.: US 10,176,764 B2
(45) Date of Patent: Jan. 8, 2019

(54) POWER SUPPLY DEVICE, DISPLAY APPARATUS HAVING THE SAME, AND METHOD FOR SUPPLYING POWER

(71) Applicant: SAMSUNG ELECTRONICS CO., LTD., Suwon-si (KR)

(72) Inventors: Du-hee Jang, Suwon-si (KR); Sang-hoon Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 111 days.

(21) Appl. No.: 14/921,359

(22) Filed: Oct. 23, 2015

(65) Prior Publication Data

US 2016/0358553 A1 Dec. 8, 2016

(30) Foreign Application Priority Data

Jun. 5, 2015 (KR) ..... 10-2015-0079924

(51) Int. Cl.
*G09G 3/34* (2006.01)
*H05B 33/08* (2006.01)

(52) U.S. Cl.
CPC ..... *G09G 3/3406* (2013.01); *H05B 33/0809* (2013.01); *G09G 2330/021* (2013.01)

(58) Field of Classification Search
CPC ..... G09G 2330/021; G09G 3/3406; H05B 33/0809
See application file for complete search history.

(56) References Cited

U.S. PATENT DOCUMENTS

2006/0192501 A1* 8/2006 Ogura ..... H02M 7/53803 315/308
2010/0156307 A1* 6/2010 Kim ..... H05B 33/089 315/224
2010/0237799 A1* 9/2010 Choi ..... H02M 3/285 315/294
2014/0334192 A1* 11/2014 Meyer ..... H02M 3/33584 363/21.01

* cited by examiner

*Primary Examiner* — Michael A Faragalla
*Assistant Examiner* — Chayce R Bibbee
(74) *Attorney, Agent, or Firm* — Sughrue Mion, PLLC

(57) ABSTRACT

A display apparatus supplies different driving powers according to a driving status of a backlight.

16 Claims, 11 Drawing Sheets

POWER SUPPLY DEVICE, DISPLAY APPARATUS HAVING THE SAME, AND METHOD FOR SUPPLYING POWER

CROSS-REFERENCE TO RELATED APPLICATIONS

This application claims priority under 35 U.S.C. § 119 from Korean Patent Application No. 10-2015-0079924, filed on Jun. 5, 2015, in the Korean Intellectual Property Office, the disclosure of which is incorporated herein by reference in its entirety.

BACKGROUND

1. Field

Method and apparatus consistent with exemplary embodiments relate to a power supply device, a display apparatus having the same, and a method for supplying power, and more particularly, to a power supply device capable of stably supplying power to a Light Emitting Diode (LED) driver without using dummy resistance or an element that endures high withstand voltage, a display apparatus having the same, and a method for supplying power.

2. Description of the Related Art

A display apparatus refers to an apparatus for processing and displaying a digital image signal or analog image signal received from an external source or diverse image signals stored in an internal storage in various formats of compressed files.

A recent display apparatus may supply power to a backlight and a system that operate under different voltages by using a multi-output power circuit. In general, the multi-output power circuit has a feedback control mechanism. However, the feedback control mechanism can control only one output voltage. That is, the multi-output power circuit feedback controls only an output voltage which is commonly supplied to a system and does not perform any feedback control with respect to a voltage which is supplied to a backlight.

Therefore, an output voltage supplied to the backlight may significantly vary depending upon load variation of the output voltage supplied to the system. In the related art, the dummy resistance is arrayed in a front end of a backlight driving circuit so that an input voltage in the backlight driving circuit does not rise.

Furthermore, the input voltage in the backlight module may rise if the input voltage is continuously input while the backlight module is not driven. In order to solve this problem, it is required to use an element that endures a withstand voltage 1.5 times higher than a withstand voltage under a normal operating condition for the backlight driving circuit.

SUMMARY

The present disclosure has been provided to address the aforementioned and other problems and disadvantages occurring in the related art, and an aspect of the present disclosure provides a power supply capable of stably supplying power to an LED driver without using dummy resistance or an element that endures high withstand voltage, a display apparatus having the same, and a method for supplying power. However, aspects of the present disclosure are not required to address the aforementioned problems, and an aspect may not address the aforementioned problems.

According to an aspect of an exemplary embodiment, a display apparatus is provided. The display apparatus includes: a panel configured to display an image by using a backlight, an image signal processor configured to provide the panel with an image signal, and a power supply configured to generate a first driving power and a second driving power, supply the generated first driving power to the backlight, and supply the generated second driving power to the image signal processor. The power supply generates a first driving power by performing voltage-doubler rectification or half-wave rectification according to a driving status of the backlight.

In response to the backlight being driven, the power supply may generate a first driving power by voltage-doubler rectifying a first output voltage of a transformer, and in response to the backlight not being driven, may generate a first driving power by half-wave rectifying the first output voltage.

The power supply may perform feedback control with respect to the second driving power. The power supply may include a first rectifier configured to rectify an external Alternating Current (AC) power into a Direct Current (DC) power, a transformer configured to multiplex-transform and output the rectified DC power, a switch configured to supply the rectified DC power to the transformer selectively, a second rectifier configured to voltage-doubler rectify or half-wave rectify a first output power output from the transformer according to the driving status of the backlight, a third rectifier configured to rectify a second output power output from the transformer and output the rectified second output power as a second driving power, and a power controller configured to control the switch to perform feedback control with respect to the second driving power.

The second rectifier may include a first capacitor configured to be connected to one end of a secondary coil of the transformer, a first diode configured to have a cathode connected to other end of the first capacitor, a second diode configured to have an anode multi-connected to the cathode of the first diode and other end of the first capacitor and a cathode connected to a first output node of the second rectifier, a third diode configured to have an anode multi-connected to one end of the secondary coil of the transformer and one end of the first capacitor and be multi-connected to a cathode of the second diode and the first output node of the second rectifier, and a Field Effective Transistor (FET) element configured to have one end connected to other end of the secondary coil of the transformer and be multi-connected to an anode of the first diode and a second output node of the second rectifier.

The power controller may receive backlight driving information from the panel or the image signal processor and controls the FET element based on the received backlight driving information.

The power supply may further include a second capacitor configured to be parallel-connected to the first output node and the second output node of the second rectifier.

The first rectifier may include a Power Factor Correction (PFC) unit configured to arrange a voltage and a current of a rectified AC power to be consistent as in-phase.

The backlight may include a Light Emitting Diode (LED) element and an LED driver configured to supply power to the LED element.

The LED driver may not have dimming resistance with respect to the power supply.

According to an aspect of an exemplary embodiment, a power supply for supplying a driving power to a Light Emitting Diode (LED) driver is provided. The power supply includes: a first rectifier configured to rectify an external Alternating Current (AC) power into a Direct Current (DC) power, a transformer configured to multiplex-transform and output the rectified DC power, a switch configured to supply the rectified DC power to the transformer selectively, a second rectifier configured to voltage-douler rectify or half-wave rectify a first output power output output from the transformer according to a driving status of the LED driver, a third rectifier configured to rectify a second output power output from the transformer, and a power controller configured to control the switch to perform feedback control with respect to the rectified second output power.

The second rectifier may include a first capacitor configured to be connected to one end of a secondary coil of the transformer, a first diode configured to have a cathode connected to other end of the first capacitor, a second diode configured to have an anode multi-connected to a cathode of the first diode and other end of the first capacitor and a cathode connected to a first output node of the second rectifier, a third diode configured to have an anode multi-connected to one end of the secondary coil of the transformer and one end of the first capacitor and be multi-connected to a cathode of the second diode and the first output node of the second rectifier, and a Field Effective Transistor (FET) element configured to have one end connected to other end of the secondary coil of the transformer and be multi-connected to an anode of the first diode and a second output node of the second rectifier.

In response to the LED driver being driven, the power controller may turn on the FET element, and in response to the LED driver not being driven, may turn off the FET element.

The power supply may further include a second capacitor configured to be parallel-connected to the first output node and the second output node of the second rectifier.

The first rectifier may include a Power Factor Correction (PFC) unit configured to arrange a voltage and a current of a rectified AC power to be consistent as in-phase.

According to an aspect of an exemplary embodiment, a method for supplying power of a power supply device for supplying a driving power to a Light Emitting Diode (LED) driver is provided. The method includes: rectifying an external Alternating Current (AC) power into a Direct Current (DC) power, selectively outputting the rectified DC power, multiplex-transforming the rectified DC power being selectively output, voltage-douler rectifying or half-wave rectifying a multiplex-transformed first output power according to a driving status of the LED driver, and supplying the voltage-doubler rectified or half-wave rectified first output power to the LED driver.

In response to the LED driver being driven, the rectifying may include voltage-doubler rectifying the multiplex-transformed first output power, and in response to the LED driver not being driven, half-wave rectifying the multiplex-transformed first output power.

The method may further include rectifying a multiplex-transformed second output power and performing feedback control with respect to the rectified second output power.

According to an aspect of an exemplary embodiment, a display apparatus is provided. The display apparatus includes: a backlight, configured to emit lights; a penal, configured to display an image by using the lights emitted from the backlight; and a power supply, configured to receive an external power having a input voltage and supply power to the backlight, wherein the power supply rectifies the input voltage to provide a voltage higher than the input voltage to the backlight when the backlight is being driven and provide a voltage substantially equal to the input voltage when the backlight is not being driven.

BRIEF DESCRIPTION OF THE DRAWINGS

The above and/or other aspects of the present disclosure will be more apparent by describing certain exemplary embodiments with reference to the accompanying drawings, in which:

FIG. 5 is a view illustrating an equivalent circuit of a second rectifier 240 in response to a FET element 245 being turned on;

FIG. 6 is an operational waveform chart illustrating each element of the second rectifier 240 in response to the FET element 245 being turned on;

DETAILED DESCRIPTION OF THE EXEMPLARY EMBODIMENTS

Figure 1:
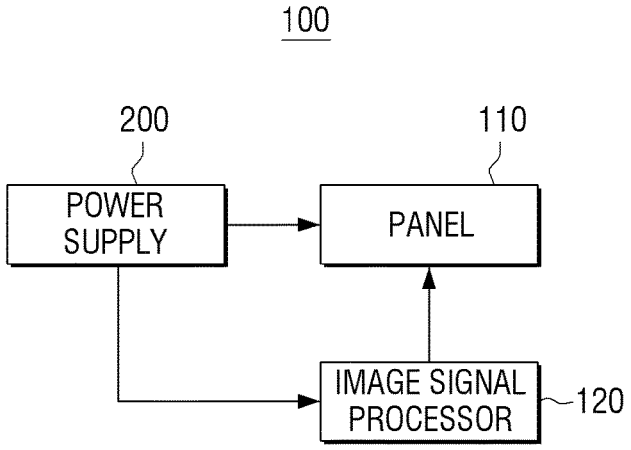
FIG. 1 is a block diagram illustrating a simple structure of a display apparatus according to an exemplary embodiment.

The exemplary embodiments of the present disclosure may be diversely modified. Accordingly, specific exemplary embodiments are illustrated in the drawings and are described in detail in the detailed description. However, it is to be understood that the present disclosure is not limited to a specific exemplary embodiment, but includes all modifications, equivalents, and substitutions without departing from the scope and spirit of the present disclosure. Also, well-known functions or constructions are not described in detail because they would obscure the disclosure with unnecessary detail.

The terms "first," "second," etc. may be used to describe diverse components, but the components are not limited by the terms. The terms are only used to distinguish one component from another component. In addition, it will be understood that when an element or layer is referred to as being "on", "connected to", "coupled to", or "adjacent to" another element or layer, it can be directly on, connected, coupled, or adjacent to the other element or layer, or intervening elements or layers may be present. In contrast, when an element is referred to as being "directly on," "directly connected to", "directly coupled to", or "immediately adjacent to" another element or layer, there are no intervening elements or layers present.

The terms used in the present application are only used to describe the exemplary embodiments, but are not intended to limit the scope of the disclosure. In addition, the singular expression does not limit the present disclosure to have singular component or step. Instead, the present disclosure may comprise multiple components or steps even it is described in singular express. In the present application, the terms "include" and "consist of" designate the presence of features, numbers, steps, operations, components, elements, or a combination thereof that are written in the specification, but do not exclude the presence or possibility of addition of one or more other features, numbers, steps, operations, components, elements, or a combination thereof.

In the exemplary embodiment of the present disclosure, a "module" or a "unit" performs at least one function or operation, and may be implemented with hardware, software, or a combination of hardware and software. In addition, a plurality of "modules" or a plurality of "units" may be integrated into at least one module except for a "module" or a "unit," which has to be implemented with specific hardware, and may be implemented with at least one processor.

Hereinafter, the present disclosure will be described in detail with reference to the accompanying drawings.

In the following description, like drawing reference numerals are used for the like elements, even in different drawings. The matters defined in the description, such as detailed construction and elements, are provided to assist in a comprehensive understanding of exemplary embodiments. However, exemplary embodiments can be practiced without those specifically defined matters. Also, well-known functions or constructions are not described in detail because they would obscure the application with unnecessary detail.

FIG. 1 is a block diagram illustrating a simple structure of a display apparatus according to an exemplary embodiment.

Referring to FIG. 1, a display apparatus 100 according to an exemplary embodiment may include a panel 110, an image signal processor 120, and a power supply 200.

The panel 110 displays an image by using a backlight. The panel 110 may be a Liquid Crystal Display (LCD) that transmits a light emitted from the backlight through the LCD or displays gradation by adjusting a transmission level. Accordingly, the panel 110 receives power necessary for the backlight from the power supply 200 and transmits the light emitted from the backlight into the liquid crystals (LC). The detailed description of the power supply 200 will be provided below. The panel 110 may receive power to be used in a pixel electrode and a common electrode from the image signal processor 120 and adjust each LC according to an image signal received from the image signal processor 120 to display an image. The detailed description of the image signal processor 120 will be provided below.

In this case, the backlight emits a light in the LCD. The backlight may include a Cold Cathode Fluorescent Lamp (CCFL), a Light Emitting Diode (LED), etc. Hereinafter, it is described that the backlight includes an LED and an LED driving circuit, but the backlight may be realized through components other than the LED in the implementation.

In this case, the backlight includes an LED driver for driving the LED. Specifically, the LED driver supplies a constant current corresponding to a brightness value to the LED so that the backlight is driven according to the brightness value corresponding to dimming information provided from the image signal processor 120. In another embodiment, the LED driver may not supply the constant current to the LED depending upon a dimming signal. The detailed description on the operations of the LED driver will be provided below with reference to FIG. 4.

The image signal processor 120 provides the panel 110 with an image signal. Specifically, the image signal processor 120 provides the panel 110 with image data and/or various image signals for displaying an image corresponding to the image data. In this case, the image signal includes data in a light emitting section for transmitting information on a light emitting level and data in an addressing section for transmitting address information to the light emitting section. The image signal has one light emitting section and one addressing section for one frame period.

The power supply 200 supplies power to respective components of the display apparatus 100. Specifically, the power supply 200 may generate a plurality of driving powers having different voltages and perform feedback control on a voltage of one of the plurality of driving powers. For example, according to the exemplary embodiment, the power supply 200 may generate a first driving power to be supplied to the backlight and a second driving power to be supplied to another component other than the backlight, and may perform feedback control on the second driving power.

In addition, the power supply 200 may generate a voltage-doubler rectified first driving power or a half-wave rectified first driving power according to a driving status of the backlight. Specifically, in response to the backlight being driven, the power supply 200 may generate the first driving power by voltage-doubler rectifying a first output voltage of a transformer. Furthermore, in response to the backlight not being driven, the power supply may generate the first driving power by half-wave rectifying the first output voltage. In this case, the voltage-doubler rectification refers to a method of charging an internal capacitor during a half period and outputting an accumulated voltage, which is the sum of the previously-charged voltage in the capacitor and an input voltage, during the other half period, thereby performing rectification so that an output voltage is higher than the input voltage. The half-wave rectification refers to a method of rectifying and outputting an input voltage only during a half period of an input AC voltage. The detailed descriptions on the components and operations of the power supply 200 will be provided below with reference to FIGS. 3 to 7.

Figure 2:
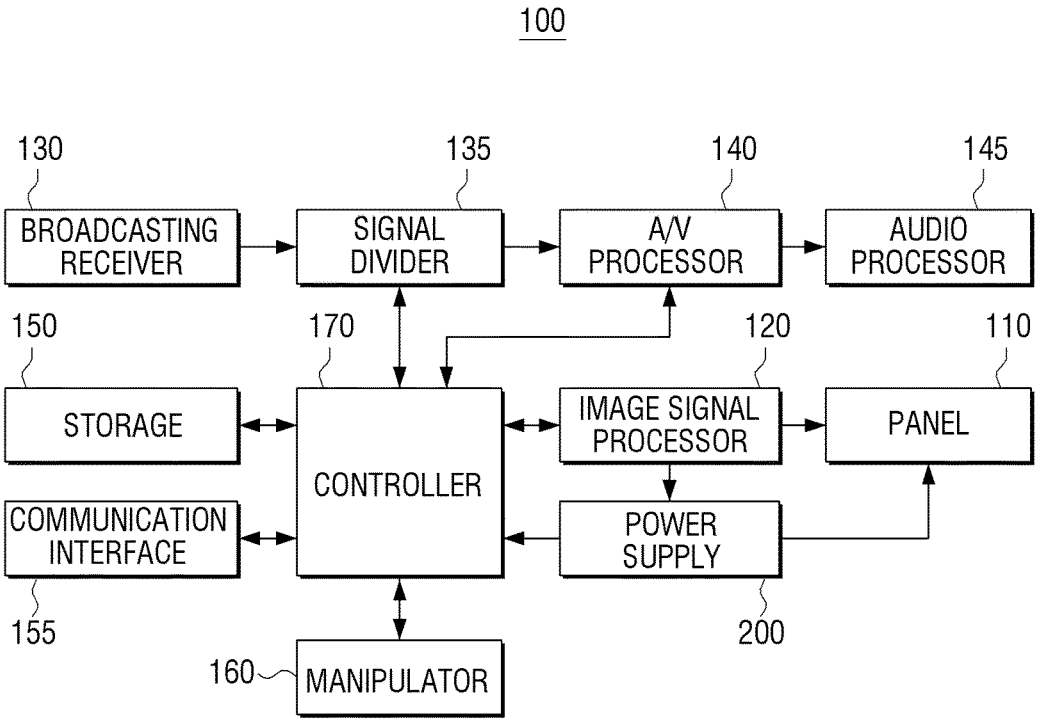
FIG. 2 is a block diagram illustrating a detailed structure of a display apparatus according to an exemplary embodiment.

As above, although the simple structure of the display apparatus 100 has been described, the display apparatus 100 may include the components illustrated in FIG. 2. The description on the detailed structure of the display apparatus 100 will be provided below with reference to FIG. 2.

FIG. 2 is a block diagram illustrating a detailed structure of a display apparatus according to an exemplary embodiment.

Referring to FIG. 2, the display apparatus 100 according to an exemplary embodiment includes a panel 110, an image signal processor 120, a broadcasting receiver 130, a signal divider 135, an Audio/Video (A/V) processor 140, an audio output unit 145, a storage 150, a communication interface 155, a manipulator 160, a controller 170, and a power supply 200.

The operations of the panel 110 and the power supply 200 have been described above in connection with FIG. 1, and thus, further illustration is omitted for brevity. In addition, in the exemplary embodiment, the power supply 200 supplies power to the panel 110 and the controller 170. However, in another embodiment, the power supply 200 may supply power to any of the other components in the display apparatus 100.

The broadcasting receiver 130 receives a broadcasting signal from a broadcasting station in a wired and/or wireless manner and demodulates the received broadcasting signal.

The signal divider 135 divides a broadcasting signal into an image signal, an audio signal, and an additional information signal. In addition, the signal divider 135 transmits the image signal and the audio signal to the A/V processor 140.

The A/V processor 140 performs a signal processing operation, such as, video decoding, video scaling, audio decoding, etc., with respect to the image signal and audio signal received from the broadcasting receiver 130 and the storage 150. In addition, the A/V processor 140 outputs the image signal to the image signal processor 120 and outputs the audio signal to the audio processor 145.

In response to the received image signal and audio signal being stored in the storage 150, the A/V processor 140 may output an image and audio to the storage 150 in a compressed form.

The audio processor 145 converts the audio signal output from the A/V processor 140 into a sound signal and outputs the sound signal through a speaker or outputs the sound to a connected external device through an external output terminal.

The image signal processor 120 generates a Graphic User Interface (GUI) for a user. In addition, the image signal processor 120 adds the generated GUI to the image output from the A/V processor 140. The image signal processor 120 provides the panel 110 with an image signal corresponding to the image to which the GUI is added. Accordingly, the panel 110 displays the image and the GUI.

In an exemplary embodiment, the image signal processor 120 may extract brightness information corresponding to the image signal and generate a dimming signal corresponding to the extracted brightness information. In addition, the image signal processor 120 may provide the panel 110 with the dimming signal. The dimming signal may be a Pulse Width Modulation (PWM) signal. However, in the actual implementation, the panel 110 may be realized to receive an image signal and autonomously generate and use a dimming signal according to the image signal.

The storage 150 may store an image content. Specifically, the storage 150 may receive and store a compressed content in which an image and an audio are compressed from the A/V processor 140. In addition, the storage 150 may output the compressed content to the A/V processor 140 according to the control of the controller 170. In an exemplary embodiment, the storage 150 may be implemented with a hard disk, a non-volatile memory, a volatile memory, etc.

The manipulator 160 may be implemented with a touch screen, a touch pad, a key button, a key pad, etc. The manipulator 160 provides a user instruction of the display apparatus 100. In an exemplary embodiment, a control command is received through the manipulator 160 in the display apparatus 100, but the manipulator 160 may be realized to receive a user instruction from an external controller (for example, remote controller).

The communication interface 155 connects the display apparatus 100 with an external device. The communication interface 155 may connect the display apparatus 100 with the external device through a Universal Serial Bus (USB) port, as well as a Local Area Network (LAN) and an internet network.

The controller 170 controls overall operations of the display apparatus 100. Specifically, the controller 170 may control the image signal processor 120 and the panel 110 so that an image corresponding to the control command received through the manipulator 160 is displayed.

As previously mentioned, the display apparatus 100 according to an exemplary embodiment uses a power supply 200 that changes and supplies power to the backlight according to the driving status of the backlight, and thus the dummy resistance for protecting a circuit in the backlight is unnecessary and the withstand voltage in the backlight may decrease.

In FIG. 2, the aforementioned function is applied only to a display apparatus that receives and displays the broadcasting. However, a power supply having the aforementioned function may be applied to any electronic apparatus having an Organic Light-Emitting Diode (OLED) panel.

In addition, in the above exemplary embodiment, the power supply 200 is a component of the display apparatus 100. However, the function of the power supply 200 may be implemented as a separate device. Hereinafter, a power supply that performs the function of the power supply 200 will be described with reference to FIG. 3

Figure 3:
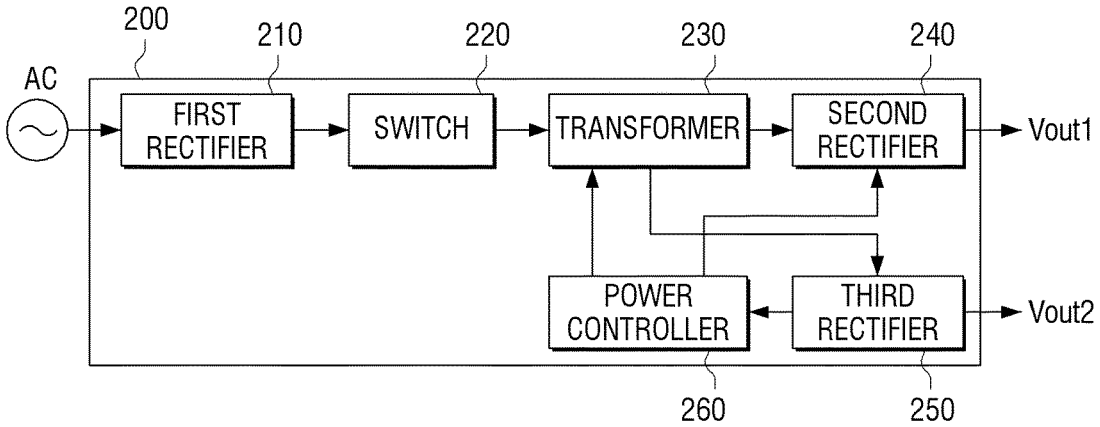
FIG. 3 is a block diagram illustrating a detailed structure of a power supply according to an exemplary embodiment.

FIG. 3 is a block diagram illustrating a detailed structure of a power supply according to an exemplary embodiment.

Referring to FIG. 3, a power supply 200 may include a first rectifier 210, a switch 220, a transformer 230, a second rectifier 240, a third rectifier 250, and a power controller 260.

The first rectifier 210 rectifies an external AC power into a DC power. Specifically, the first rectifier 210 may rectify an AC power provided from an external source into a predetermined level of DC power.

The first rectifier 210 may include a Power Factor Correction (PFC) unit that arranges a voltage and a current of the rectified AC power to be consistent as in-phase. In addition, the first rectifier 210 may include a smoother for smoothing the rectified power.

The switch 220 selectively supplies the rectified DC power to the transformer 230. Specifically, the switch 220 may selectively supply the DC power output from the first rectifier 210 to the transformer 230 according to the control of the power controller 260. The detailed description on the power controller 260 will be provided below.

The transformer 230 transforms the rectified DC power and outputs the transformed DC power as a driving power. Specifically, the power supply 200 according to an exemplary embodiment may be implemented with a multiplex-transformer for generating driving powers having different voltages. Accordingly, the transformer 230 may multiplex-transform and output the rectified DC power. For example, the transformer 230 may include a primary coil and a plurality of secondary coils, and the plurality of secondary coils may introduce different transformation ratios. In this embodiment, a power output from one secondary coil may be an input power of the second rectifier 240 and regarded as a first output power, and a power output from another secondary coil may be an input power of the third rectifier 250 and regarded as a second output power. Moreover, in the exemplary embodiment, the transformer 230 includes two secondary coils, but in the implementation, the transformer 230 may include three or more secondary coils.

The second rectifier 240 voltage-doubler rectifies or half-wave rectifies a first output power (Vout1) output from the transformer 230 according to the driving status of the backlight. Specifically, in response to the backlight being driven, the second rectifier 240 may voltage-doubler rectify the first output power and output the rectified first output power as a first driving power (Vout1). In this embodiment, the voltage-doubler rectification refers to a method of charging a capacitor during a half-period by using a capacitor and a plurality of diodes and outputting an accumulated voltage of the charged voltage and an input voltage during the other half-period.

Further, in response to the backlight not being driven, the second rectifier 240 may half-wave rectify the first output power and output the rectified first output power as the first driving power (Vout1). In this embodiment, the half-wave rectification refers to a method of outputting an input voltage only during a half-period by using one diode. The detailed descriptions on the components and operations of the second rectifier 240 will be provided below with reference to FIGS. 4 to 8.

The third rectifier 250 may rectify a second output power output from the transformer 230 and output the rectified second output power as a second driving power (Vout2). The third rectifier 250 may be realized as a full-bridge rectifier circuit, a voltage-doubler rectifier circuit, a center-tap rectifier circuit, a half-wave rectifier circuit, etc. The second driving power (Vout2) that is an output voltage of the third rectifier 250 may be supplied to the power controller 260.

The power controller 260 performs the feedback control with respect to the second driving voltage (Vout2). In this embodiment, the feedback control refers to a control operation of comparing a control value with a desired value and performing a correcting operation for making the control value and the desired value be consistent with each other. Specifically, the power controller 260 may control a switching operation of the switch so that an output of the second driving power (Vout2) maintains a predetermined voltage level (for example, 12V).

The power controller 260 changes the rectifying operation of the second rectifier 240 according to the driving status of the backlight. In this embodiment, the power controller 260 may control the second rectifier 240 to perform the voltage-doubler rectification in response to the backlight being driven, and may control the second rectifier 240 to perform half-wave rectification in response to the backlight not being driven.

For the above operation, the power controller 260 may receive a dimming signal from the panel 110 or the image signal processor 120 and determine the driving status of the backlight according to the received dimming signal. In an exemplary embodiment, the power controller 260 may provide the FET element in the second rectifier 240 with a control signal to control the second rectifier. Therefore, when the dimming signal indicates the backlight is being driven, the power controller 260 may turn on the FET to allow the second rectifier to perform the voltage-doubler rectification. In addition, when the dimming signal indicates the backlight does not need to be driven, the power controller 260 may turn off the FET element in the second rectifier 240 so that the second rectifier 240 performs the half-wave rectification.

As previously mentioned, the power supply 200 according to an exemplary embodiment changes and supplies power for the backlight according to the driving status of the backlight, and thus, the dummy resistance for protecting a circuit in the backlight is unnecessary, and the withstand voltage in the backlight may decrease.

Figure 4:
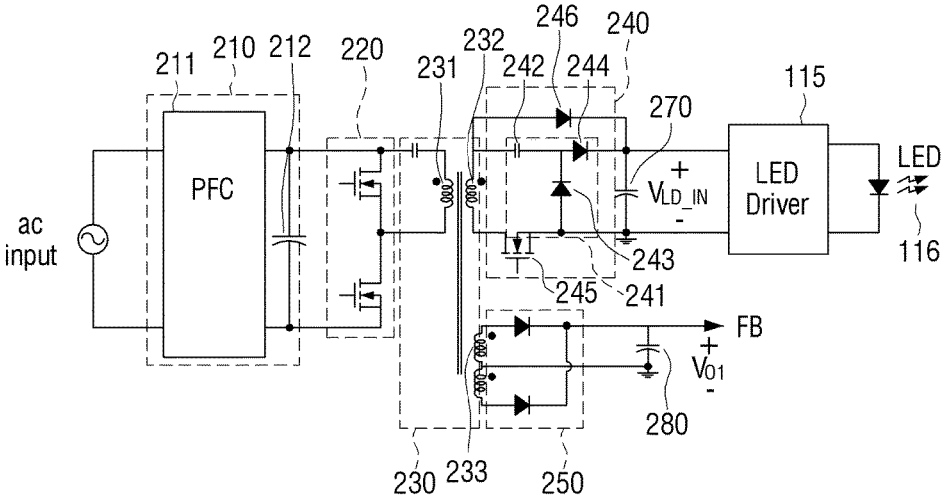
FIG. 4 is a circuit diagram of a power supply according to an exemplary embodiment.

FIG. 4 is a circuit diagram of a power supply device according to an exemplary embodiment.

Referring to FIG. 4, the power supply 200 may include a first rectifier 210, a switch 220, a transformer 230, a second rectifier 240, and a third rectifier 250.

The first rectifier 210 rectifies an external AC power into a DC power. Specifically, the first rectifier 210 may include a Power Factor Correction (PFC) unit 211 and a capacitor 212.

The PFC unit 211 outputs a rectified AC power of which voltage and current are consistent as in-phase. Specifically, the PFC unit 211 of FIG. 4 rectifies the external AC power and arranges a voltage and a current of the rectified AC power to be consistent as in-phase. In addition, in the exemplary embodiment, the PFC unit 211 performs all of the above described operations. However, in the implementation, a separate rectifier circuit may be arrayed in a front end of the PFC unit, and the PFC unit may perform only the operation of arranging phases of the voltage and current to be consistent.

The capacitor 212 smooths the AC power of which voltage and current are arranged to be consistent as in-phase. Specifically, the capacitor 212 may smooth the AC power output from the PFC unit 211 to a predetermined level of DC power.

The switch 220 includes a switching element. Specifically, the switching element has one end connected to an output terminal of the first rectifier 210 and the other end connected to an input terminal of the transformer 230. Accordingly, the switch 220 may selectively supply the DC power of the capacitor 212 to the transformer 230. Furthermore, in the exemplary embodiment, the switch 220 uses two switching elements. However, in the implementation, the switch 220 may be implemented with only one switching element to selectively supply the DC power of the capacitor 212 to the transformer 230.

The transformer 230 transforms the rectified DC power and outputs a driving power. Specifically, the transformer 230 includes one primary coil 231 and a plurality of secondary coils 232, 233. Accordingly, the transformer 230 may output the DC power of the first rectifier 210 received through the switch 220 as the first output power to correspond to the transformation ratios of the primary coil 231 and the secondary coil 232. In addition, the transformer 230 may output the DC power of the first rectifier 210 received through the switch 220 as the second output power so as to correspond to the transformation ratios of the primary coil 231 and the secondary coil 233.

The second rectifier 240 voltage-doubler rectifies or half-wave rectifies the first output power output from the transformer 230 according to the driving status of the backlight. Specifically, the second rectifier 240 may include a first capacitor 242, a first diode 243, a second diode 244, a third diode 246, an FET element 245, and a second capacitor 270.

The first capacitor 242 is connected to one end of the secondary coil 232 of the transformer 230. Specifically, the first capacitor 242 may have one end connected to one end of the secondary coil 232 of the transformer 230 and an anode of the third diode 246 and the other end connected to a cathode of the first diode 243 and an anode of the second diode 244.

The first diode 243 may have a cathode connected to the other end of the first capacitor 242 and the anode of the second diode 244 and an anode connected to one end of the FET element 245 and a second output node of the second rectifier 240.

The second diode 244 may have an anode connected to the other end of the first capacitor 242 and the cathode of the first diode 243 and a cathode connected to the first output node of the second rectifier 240 and a cathode of the third diode 246.

The third diode 246 may have an anode connected to one end of the secondary coil 232 of the transformer 230 and one end of the first capacitor 242 and the cathode connected to the cathode of the second diode 244 and the first output node of the second rectifier 240. The second capacitor 270 is connected between the first output node and the second output node.

The FET element 245 has one end connected to the other end of the secondary coil 232 of the transformer 230 and the other end connected to the anode of the first diode 243 and the output node ($V_{LD_IN}$) of the second rectifier 240. The FET element 245 may work as a switch, that can be turned on or turned off according to the control of the power controller 260. The detailed description on the operation of the second rectifier 242 according to the switching operation of the FET element 245 will be provided below with reference to FIGS. 5 to 8.

The third rectifier 250 may rectify the second output power output from the secondary coil 233 of the transformer 230 and output the rectified second output power as a second driving power. Moreover, in the exemplary embodiment, the third rectifier 250 rectifies the second output power by using a center-tap rectifier circuit. However, in the implementation, the third rectifier 250 may rectify the second output power of the transformer 230 as a DC power by using another rectifier circuit such as full-bridge rectifier circuit, a voltage-doubler rectifier circuit, a half-wave rectifier circuit, or etc. In this case, the rectified output power of the second rectifier 240 may be supplied to each component of the display apparatus 100 as the second driving power and may be supplied to the power controller 260 for the feedback control operation.

The LED driver 115 generates and supplies the constant current necessary for the LED by using the first driving power supplied from the second rectifier 240. Specifically, the LED driver 115 may receive a dimming signal from an external source and supply the constant current corresponding to the received dimming signal to the LED. In addition, in the exemplary embodiment, the LED driver 115 drives one LED (or LED array), but the LED driver 115 may supply different constant currents to a plurality of LED arrays.

Hereinafter, the detailed description on the operations of the second rectifier 240 when the FET element 245 is turned on will be provided with reference to FIGS. 5 to 6.

Figure 5:
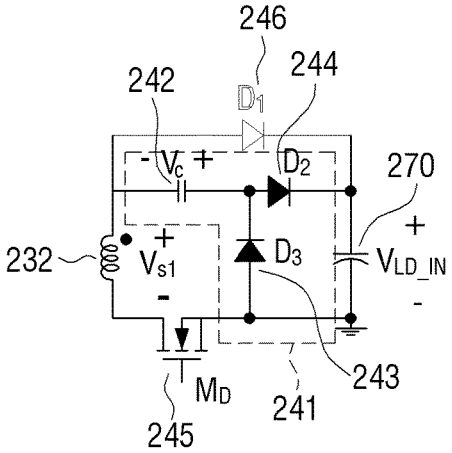
Figure 6:
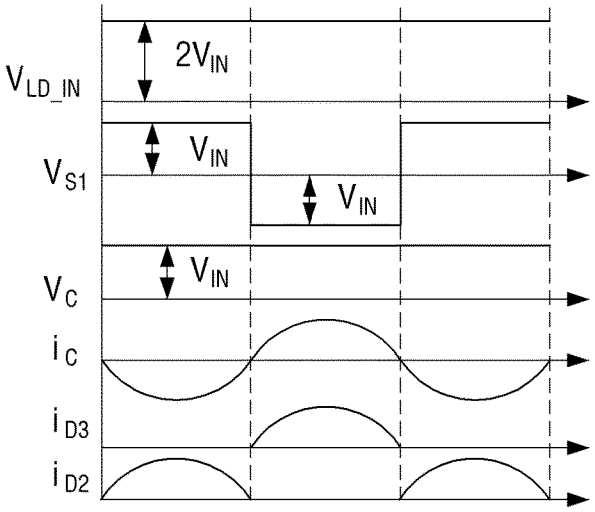

FIG. 5 is a view illustrating an equivalent circuit of the second rectifier 240 in response to the FET element 245 being turned on, and FIG. 6 is an operational waveform chart illustrating each element of the second rectifier 240 in response to the FET element 245 being turned on.

Referring to FIGS. 5 and 6, the backlight (specifically, LED driving circuit) is driven, and the FET element 245 is turned on. During a negative half-period of an input power ($V_{S1}$) where input power ($V_{S1}$) across the secondary coil 232 has a negative voltage value, the second diode (D2) 244 is in an open state. In addition, the voltage ($V_{LD_IN}$) of the first output node is higher than a voltage of the secondary coil 232 ($V_{S1}$), and thus, the third diode (D1) 246 is also in the open state. Accordingly, a first current path that passes through the secondary coil 232, the FET element 245, the first diode (D3) 243, and the first capacitor 242 is generated. The input power ($V_{S1}$) is charged with the first capacitor 242. In addition, the first output node is shorted out of the secondary coil 232, and a voltage value ($V_{LD_IN}$) charged with the output capacitor 270 is maintained.

In addition, during a positive half-period of the input power ($V_{S1}$) where the secondary coil 232 has a positive value, the first diode (D3) 243 is in the open state. In addition, the voltage($V_{LD_IN}$) of the first output node is higher than the voltage of the secondary coil ($V_{S1}$), and thus, the third diode (D1) 243 is also in the open state. Accordingly, a current path that passes through the secondary coil 232, the first capacitor 242, the second diode (D2) 244, the output nodes, and the FET element 245 is generated. In this case, a voltage of the first capacitor 242 and the voltage of the secondary coil 232 are added to the first output node, and thus, the first driving power ($V_{LD_IN}$) becomes $2V_{S1}$ that is two times greater than the input power ($V_{S1}$).

Figure 7:
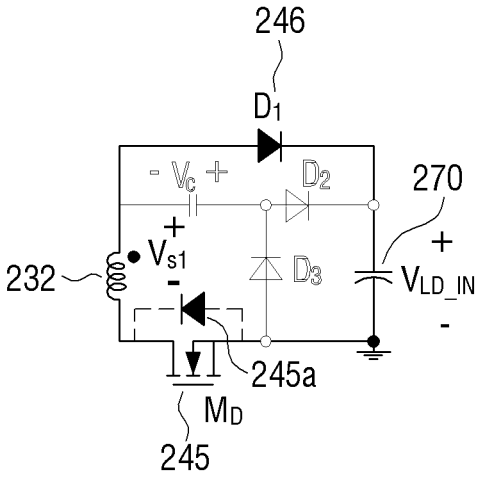
FIG. 7 is a view illustrating an equivalent circuit of the second rectifier 240 in response to the FET element 245 being turned off.
Figure 8:
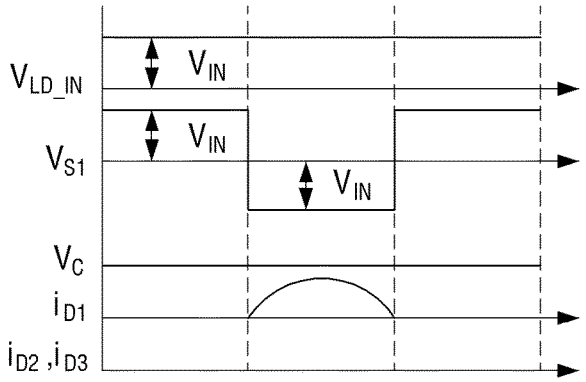
FIG. 8 is an operational waveform chart illustrating each element of the second rectifier 240 in response to the FET element 245 being turned off.

FIG. 7 is a view illustrating an equivalent circuit of the second rectifier 240 in response to the FET element 245 being turned off, and FIG. 8 is an operational waveform chart illustrating each element of the second rectifier 240 in response to the FET element 245 being turned off.

Referring to FIGS. 7 and 8, the backlight (specifically, LED driving circuit) is not driven, and the FET element 245 is turned off. The FET element 245 includes a parasitic diode, and thus, the FET element 245 is turned on during the positive half-period of the input power ($V_{S1}$) where the input power ($V_{S1}$) across the secondary coil 232 has the positive voltage value and is in the open state during the negative half-period. Accordingly, the second rectifier 240 has a current path that passes through the secondary coil 232, the third diode (D1) 246, and the output nodes during only the positive half-period of the input power ($V_{S1}$) where the input power ($V_{S1}$) across the secondary coil 232 has the positive value. That is, the second rectifier 240 operates as a common half-wave rectifier circuit. The power (Vc) of the first capacitor maintains a voltage value of 0. Accordingly, the input voltage of the LED driver 115, that is voltage $V_{LD_IN}$, maintains the voltage $V_{IN}$, which is the same as $V_{S1}$.

Comparing the present exemplary embodiment with the above exemplary embodiments of FIGS. 5 and 6, in the half-wave rectifier circuit, the voltage of the output first driving power is half. Accordingly, in response to the LED driver 115 not being driven, the second rectifier 240 supplies a driving voltage lower than a driving voltage when the LED driver 115 is driven, and thus, the voltage stress of the LED driver 115 may be reduced without using the dummy resistance.

Figure 9:
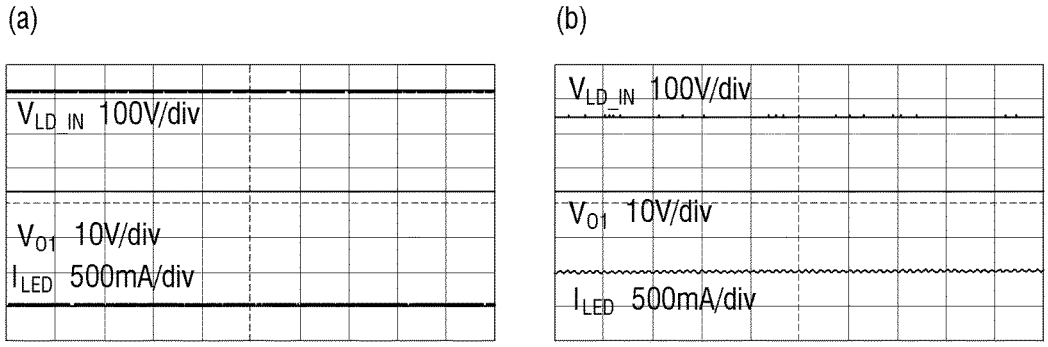
FIG. 9 is a simulation chart illustrating a waveform of a driving voltage of a power supply in the related art.

FIG. 9 is a simulation chart illustrating a waveform of a driving voltage of a power supply device in the related art. Specifically, FIG. 9*a* is a simulation waveform chart illustrating a driving voltage when the LED driver is not being driven, and FIG. 9*b* is a simulation waveform chart illustrating a driving voltage in response to the LED driver being driven. In this case, a non-driven state of the LED driver signifies that the constant current is not supplied to the LED and does not signify that the input power is not input into the LED driver.

Referring to FIGS. 9*a* and 9*b*, an LED input power ($V_{LD_IN}$) has approximately voltage value 253V in response to the LED driver 115 being driven. In response to the LED driver 115 not being driven, the LED input power ($V_{LD_IN}$) rises up to a voltage level higher than a voltage level when the LED driver 115 is driven (that is, approximately 324V). That is, in response to the LED driver 115 not being driven, the power supply in the related art supplies an input voltage higher than a voltage when the LED driver 115 is driven, and thus, the LED driver in the related art needs to include an element that endures at least the withstand voltage 324V.

Figure 10:
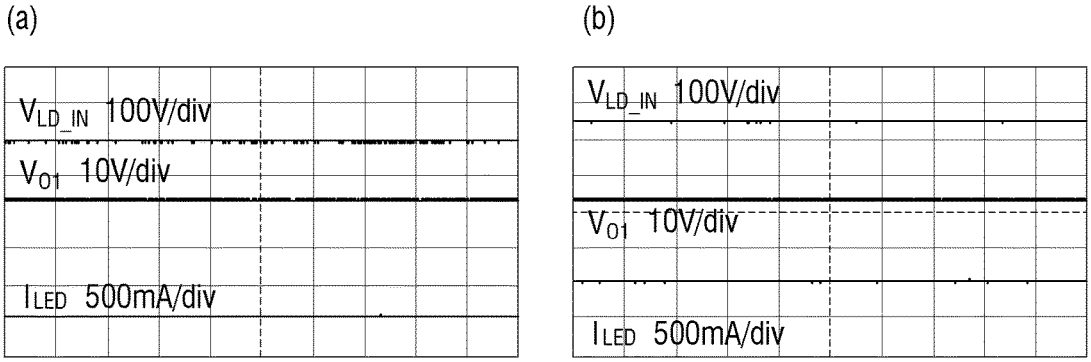
FIG. 10 is a simulation chart illustrating a waveform of a driving voltage of a power supply according to an exemplary embodiment.

FIG. 10 is a simulation graph illustrating a waveform of a driving voltage of a power supply according to an exemplary embodiment. Specifically, FIG. 10*a* is a simulation waveform chart illustrating a driving voltage in response to an LED driver not being driven, and FIG. 10*b* is a simulation waveform chart illustrating a driving voltage in response to an LED driver being driven.

Referring to FIG. 10*b*, in response to the LED driver 115 being driven, a required level of driving voltage (approximately 246V) is supplied to the LED driver 115 as illustrated in FIG. 9*b*.

Referring to FIG. 10*a*, in response to the LED driver 115 not being driven, a driving voltage lower than a driving voltage when the LED driver 115 is driven is supplied to the LED driver 115. That is, when the LED driver 115 is not driven, a lower voltage may be supplied to the LED driver 115 effectively without using the dummy resistance. In addition, the input voltage of the LED driver 115 does not rise when the LED driver 115 is not driven, and thus, the withstand voltage of the LED driver 115 may decrease.

Figure 11:
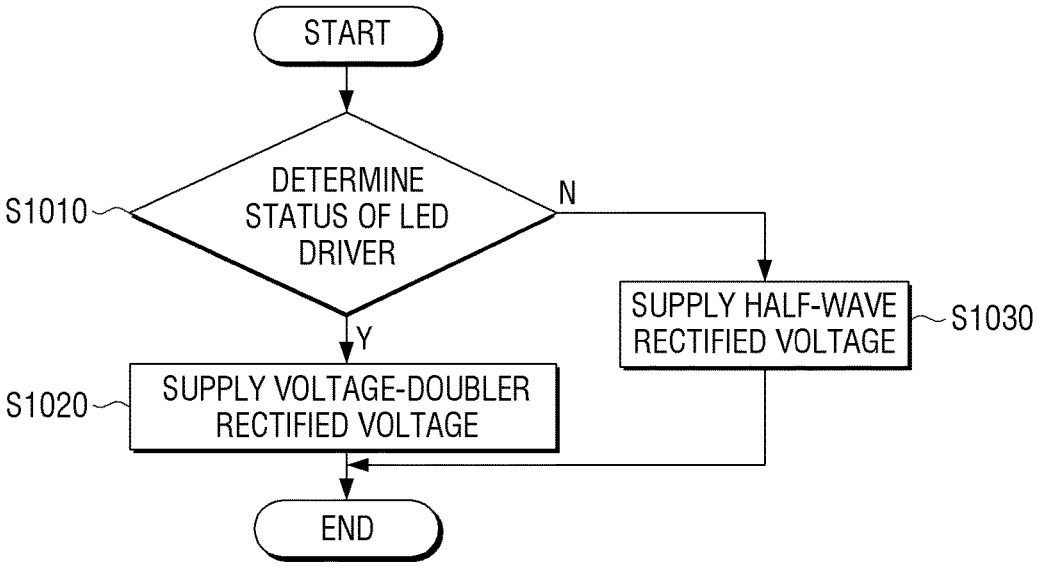
FIG. 11 is a flowchart provided to describe a method for supplying power according to an exemplary embodiment.

FIG. 11 is a flowchart provided to describe a method for supplying power according to an exemplary embodiment.

Referring to FIG. 11, an external AC power is rectified into a DC power, the rectified DC power is output selectively, and the rectified DC power selectively being output is multiplex-transformed.

A driving status of an LED driver is determined (S1010). Specifically, the driving status of the LED driver may be determined based on a dimming signal provided to the LED driver. In the implementation, the driving status of the LED driver may be determined by sensing a current that flows in an LED or sensing light emission of the LED through a sensor.

According to the driving status of the LED driver, a multiplex-transformed first output power is voltage-doubler rectified or half-wave rectified. Specifically, in response to the LED driver being driven (S1010-Y), the first output power is voltage-doubler rectified (S1020). In response to the LED driver not being driven (S1010-N), the first output power is half-wave rectified (S1030). The detailed rectifying methods have been described above with reference to FIGS. 5 to 8, and thus, the related description is omitted.

The voltage-doubler rectified or half-wave rectified first output power is supplied to the LED driver.

As described above, the method for supplying power according to an exemplary embodiment changes and supplies power for the backlight according to the driving status of the backlight, and thus, the dummy resistance for protecting a circuit in the backlight is unnecessary, and the withstand voltage in the backlight may decrease. The method of FIG. 11 may be executed in a display apparatus having the structure of FIG. 1 or FIG. 2 or in a power supply having the structure of FIG. 3. The method of FIG. 11 may be also executed in a display apparatus or power supply having another structure.

In addition, the method for supplying power according to above described various exemplary embodiments may be realized as an executable algorithm that may be executed in a computer. The program may be provided through a non-transitory computer readable medium.

The non-transitory computer readable medium refers to a medium that may store data permanently or semi-permanently rather than storing data for a short time, such as, register, cache, memory, etc., and may be readable by an apparatus. Specifically, the above-described various applications and programs may be stored in and provided through the non-transitory computer readable medium, such as, Compact Disc (CD), Digital Versatile Disk (DVD), hard disk, Blu-ray disk, Universal Serial Bus (USB), memory card, Read-Only Memory (ROM), etc.

As above, a few exemplary embodiments have been shown and described. The foregoing exemplary embodiments and advantages are merely exemplary and are not to be construed as limiting the present application. The present teaching can be readily applied to other types of devices. Also, the description of the exemplary embodiments is intended to be illustrative, and not to limit the scope of the claims, and many alternatives, modifications, and variations will be apparent to those skilled in the art.

What is claimed is:

1. A display apparatus comprising:

a panel;

a backlight;

a processor configured to control the panel to display an image by using a light emitted from the backlight; and a power supply configured to generate a first driving power and a second driving power, supply the first driving power to the backlight, and supply the second driving power to the processor, wherein the power supply comprises a transformer and a first rectifier which is connected with the backlight, wherein the first rectifier comprises a field effective transistor (FET), wherein the power supply is configured to perform voltage-doubler rectification or half-wave rectification by controlling an on/off state of the FET, and wherein the power supply is configured to, based on the backlight being driven, generate the first driving power by performing the voltage-doubler rectification on an output voltage of the transformer, and based on the backlight not being driven, generate the first driving power by performing the half-wave rectification on the output voltage of the transformer.

2. The display apparatus as claimed in claim 1, wherein the power supply if further configured to perform feedback control with respect to the second driving power.

3. The display apparatus as claimed in claim 1, wherein the power supply comprises:

a second rectifier configured to rectify an external Alternating Current (AC) power into a Direct Current (DC) power;

a switch configured to selectively supply the rectified DC power to the transformer;

a third rectifier configured to rectify a second output power output from the transformer and output the rectified second output power as the second driving power; and a power controller configured to perform feedback control with respect to the second driving power by controlling the switch, wherein the first rectifier performs voltage-doubler rectification or half-wave rectification on a first output power output from the transformer according to a driving status of the backlight and output the rectified first output power as the first driving power, and wherein the transformer is configured to multiplex transform the rectified DC power.

4. The display apparatus as claimed in claim 3, wherein the first rectifier comprises:

a first capacitor configured to be connected to one end of a secondary coil of the transformer;

a first diode configured to have a cathode connected to the other end of the first capacitor;

a second diode configured to have an anode connected to the cathode of the first diode and the other end of the first capacitor and a cathode connected to a first output node of the second rectifier; and a third diode configured to have an anode connected to one end of the secondary coil of the transformer and one end of the first capacitor and be connected to a cathode of the second diode and the first output node of the second rectifier, wherein the Field Effective Transistor (FET) configured to have one end connected to the other end of the secondary coil of the transformer and be connected to an anode of the first diode and a second output node of the second rectifier.

5. The display apparatus as claimed in claim 4, wherein the power controller is further configured to receive backlight driving information from the panel or the processor and control the FET based on the backlight driving information.

6. The display apparatus as claimed in claim 4, wherein the power supply further comprises a second capacitor configured to be parallel-connected to the first output node and the second output node of the second rectifier.

7. The display apparatus as claimed in claim 3, wherein the second rectifier comprises a Power Factor Correction (PFC) unit configured to arrange a voltage and a current of a rectified AC power to be consistent as in-phase.

8. The display apparatus as claimed in claim 1, wherein the backlight comprises a Light Emitting Diode (LED) element and an LED driver configured to supply power to the LED element.

9. The display apparatus as claimed in claim 8, wherein the LED driver is directly connected to the power supply.

10. A power supply for supplying a driving power to a Light Emitting Diode (LED) driver, the power supply comprising:

a first rectifier configured to comprise a Field Effective Transistor (FET) and connect with a backlight configured to emit light;

a second rectifier configured to rectify an external Alternating Current (AC) power into a Direct Current (DC) power;

a transformer configured to multiplex-transform and output the rectified DC power;

a switch configured to selectively supply the rectified DC power to the transformer;

a third rectifier configured to rectify a second output power output from the transformer; and a power controller configured to control a second switch configured to perform feedback control with respect to the rectified second output power, wherein the first rectifier performs voltage-doubler rectification or half-wave rectification on a first output power output from the transformer by controlling an on/off state of the FET according to a driving status of the LED driver, and wherein the first rectifier is further configured to, based on the LED driver being driven, generate a driving power by performing voltage-doubler rectification on the first output power, and based on the LED driver not being driven, generate the driving power by performing half-wave rectification on the first output power.

11. The power supply as claimed in claim 10, wherein the first rectifier comprises:

a first capacitor configured to be connected to one end of a secondary coil of the transformer;

a first diode configured to have a cathode connected to the other end of the first capacitor;

a second diode configured to have an anode connected to a cathode of the first diode and the other end of the first capacitor and a cathode connected to a first output node of the second rectifier;

a third diode configured to have an anode connected to one end of the secondary coil of the transformer and one end of the first capacitor and be connected to a cathode of the second diode and the first output node of the second rectifier; and wherein the Field Effective Transistor (FET) configured to have one end connected to the other end of the secondary coil of the transformer and be connected to an anode of the first diode and a second output node of the second rectifier.

12. The power supply as claimed in claim 11, wherein the power controller is further configured to, in response to the LED driver being driven, turn on the FET, and in response to the LED driver not being driven, turn off the FET.

13. The power supply as claimed in claim 11, further comprising:

a second capacitor configured to be parallel-connected to the first output node and the second output node of the second rectifier.

14. The power supply as claimed in claim 10, wherein the second rectifier comprises a Power Factor Correction (PFC) unit configured to arrange a voltage and a current of a rectified AC power to be consistent as in-phase.

15. A method for supplying power of a power supply for supplying a driving power to a Light Emitting Diode (LED) driver, the method comprising:

rectifying an external Alternating Current (AC) power into a Direct Current (DC) power;

selectively outputting the rectified DC power;

multiplex-transforming the rectified DC power being selectively output;

performing voltage-doubler rectification or half-wave rectification on a multiplex-transformed first output power by controlling an on/off state of a Field Effective Transistor (FET) comprised in a first rectifier according to a driving status of the LED driver; and supplying the voltage-doubler rectified or half-wave rectified first output power to the LED driver, wherein the performing voltage-doubler rectification or half-wave rectification on the multiplex-transformed first output power comprises, based on the LED driver being driven, generating a driving power by performing voltage-doubler rectification on the multiplex-transformed first output power, and based on the LED driver not being driven, generating a driving power by performing half-wave rectification on the multiplex-transformed first output power.

16. The method as claimed in claim 15, further comprising:

rectifying a multiplex-transformed second output power; and performing feedback control with respect to the rectified second output power.

* * * * *